US010262579B2

(12) United States Patent
Zeng

(10) Patent No.: US 10,262,579 B2
(45) Date of Patent: Apr. 16, 2019

(54) DRIVE SYSTEM AND DRIVE METHOD OF LIQUID CRYSTAL DISPLAY

(71) Applicant: Shenzhen China Star Optoelectronics Technology Co., Ltd., Shenzhen, Guangdong (CN)

(72) Inventor: Dekang Zeng, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 157 days.

(21) Appl. No.: 15/300,977

(22) PCT Filed: Jul. 14, 2016

(86) PCT No.: PCT/CN2016/090066
§ 371 (c)(1),
(2) Date: Sep. 30, 2016

(87) PCT Pub. No.: WO2017/201839
PCT Pub. Date: Nov. 30, 2017

(65) Prior Publication Data

US 2018/0096646 A1 Apr. 5, 2018

(30) Foreign Application Priority Data

May 25, 2016 (CN) ..... 2016 1 0357513

(51) Int. Cl.
*G09G 3/20* (2006.01)
*G09G 3/36* (2006.01)

(52) U.S. Cl.
CPC ..... *G09G 3/2096* (2013.01); *G09G 3/3614* (2013.01); *G09G 3/3648* (2013.01);
(Continued)

(58) Field of Classification Search
CPC .. G09G 3/2096; G09G 3/3614; G09G 3/3688; G09G 3/3611
See application file for complete search history.

(56) References Cited

U.S. PATENT DOCUMENTS

2001/0013850 A1 8/2001 Sakaguchi
2005/0030276 A1* 2/2005 Murakami ..... G09G 3/3677 345/102

(Continued)

FOREIGN PATENT DOCUMENTS

CN 101013566 A 8/2007
CN 101593481 A 12/2009

(Continued)

*Primary Examiner* — Kevin M Nguyen
(74) *Attorney, Agent, or Firm* — Andrew C. Cheng

(57) ABSTRACT

There provides a drive system for a liquid crystal display, which includes: a timing controller for generating a scanning start signal; a level shifter for boosting the generated scanning start signal and generating at least one clock signal according to the boosted scanning start signal; and a gate driver for scanning and driving gate lines according to the boosted scanning start signal and the generated clock signal. There also provides a drive method of a liquid crystal display. With the drive system and drive method of a liquid crystal display provided in the present invention, it can reduce the pins required by the timing controller and the level shifter, thus the packages of the timing controller and the level shifter get smaller, thereby reducing the package cost.

10 Claims, 4 Drawing Sheets

(52) U.S. Cl.
CPC ... *G09G 3/3688* (2013.01); *G09G 2300/0408* (2013.01); *G09G 2310/0289* (2013.01); *G09G 2310/08* (2013.01); *G09G 2320/0673* (2013.01); *G09G 2370/08* (2013.01)

(56) References Cited

U.S. PATENT DOCUMENTS

| | | | | |
|---|---|---|---|---|
| 2006/0044295 | A1 | 3/2006 | Yu | |
| 2009/0167668 | A1* | 7/2009 | Kim | G09G 3/3677 345/100 |
| 2010/0315396 | A1 | 12/2010 | Weng | |
| 2011/0148954 | A1* | 6/2011 | Tobita | G09G 3/3688 345/698 |
| 2012/0133627 | A1* | 5/2012 | Moon | G09G 3/3648 345/208 |
| 2013/0249781 | A1* | 9/2013 | Park | G09G 3/3688 345/99 |
| 2015/0187313 | A1* | 7/2015 | Lee | G09G 3/3674 345/100 |

FOREIGN PATENT DOCUMENTS

| | | | |
|---|---|---|---|
| CN | 102637415 | A | 8/2012 |
| CN | 103236244 | A | 8/2013 |
| CN | 103745702 | A | 4/2014 |
| CN | 104680991 | A | 6/2015 |
| CN | 105096868 | A | 11/2015 |
| CN | 105390106 | A | 3/2016 |

* cited by examiner

DRIVE SYSTEM AND DRIVE METHOD OF LIQUID CRYSTAL DISPLAY

TECHNICAL FIELD

The present invention relates to a liquid crystal display technology field, in particular, to a drive system and a drive method of a liquid crystal display.

BACKGROUND ART

The development of photoelectricity and semiconductor technology has led to a booming of Flat Panel Display. Liquid Crystal Display (LCD) in numerals Flat Panel Displays has been applied in various aspects of production and living for its favorable characteristics such as high efficiency in space utilization, low power consumption, radiationless and low electromagnetic interference etc.

The liquid crystal display generally includes a liquid crystal panel and a backlight module to provide uniform area light source to the liquid crystal panel. In the liquid crystal panel, a Gate Driver on Array (GOA) technology is usually used to make agate driver produced on an array substrate such that gate lines can be scanned and driven progressively.

In the GOA technology, a Printed Circuit Board Assembly (PCBA) is generally used to provide various signals to the gate driver. For example, in general, PCBA may include a Timing Controller (TCON) and a level shifter formed thereon. TCOM generates a start signal (STV), a clock signal (CLK) and the like to the level shifter, and then the level shifter performs a boosting operation on the received signal, in order to scan and drive the gate lines (as well as a thin film transistors TFT connected to the gate lines) progressively.

For the sake of implementation of scanning and driving the gate lines line-by-line, at least four clock signals are required to be provided to the gate driver. The more the clock signals required by the gate driver are, the more the pins required by TCON and the level shifter are, this would cause packages of the TCON and the level shifter get larger, thereby the package cost increases. Meanwhile, due to the increasing of the pins, which leads to an increase on routing, thus a size of the PCBA may get larger, and the cost of PCBA increases.

SUMMARY

To solve the above problem, the present invention provides a drive system and a drive method of a liquid crystal display capable of reducing pins required by the TCON and the level shifter.

According to an aspect of the present invention, there provides a drive system for a liquid crystal display, which comprises: a timing controller for generating a scanning start signal; a level shifter for boosting the generated scanning start signal and generating at least one clock signal according to the boosted scanning start signal; and a gate driver for scanning and driving gate lines according to the boosted scanning start signal and the generated clock signal.

Alternately, the level shifter is also used to store at least one preset value, and perform a delay operation on the boosted scanning start signal according to the stored preset value, so as to generate a clock signal.

Alternately, the level shifter is also used to perform a delay operation on the boosted scanning start signal according to the stored preset value when a rising edge of the boosted scanning start signal is detected, so as to generate a clock signal.

Alternately, the level shifter comprises: a boost module for boosting the generated scanning start signal; a storage module for storing at least one preset value; a detection module for detecting a rising edge of the boosted scanning start signal; a delay module for acquiring the preset value from the storage module when the detection module detects the rising edge of the boosted scanning start signal, and performing a delay operation on the boosted scanning start signal according to the acquired preset value, so as to generate a clock signal; and an output module for outputting the boosted scanning start signal and the generated clock signal.

Alternately, when the storage module stores at least two preset values, the delay module may acquire preset values successively in an order from the minimum preset value to the maximum preset value, and perform a delay operation on the boosted scanning start signal according to each of the acquired preset values, so as to generate clock signals corresponding to each of the preset values.

Alternately, a delay time for the boosted scanning start signal gets longer successively in an order from the minimum preset value to the maximum preset value.

Alternately, the timing controller and the level shifter are assembled on the PCBA, and the level shifter includes: an IIC protocol module for communicating with a connector on the PCBA.

According to another aspect of the present invention, there provides a drive method of a liquid crystal display, which comprises: generating a scanning start signal; boosting the generated scanning start signal; generating a clock signal according to the boosted scanning start signal; and scanning and driving gate lines according to the boosted scanning start signal and the generated clock signal;

Alternately, the method of generating the clock signal according to the boosted scanning start signal comprises: detecting a rising edge of the boosted scanning start signal; acquiring the stored preset value when the rising edge of the boosted scanning start signal is detected; performing a delay operation on the boosted scanning start signal according to the acquired preset value, so as to generate a clock signal; and outputting the boosted scanning start signal and the generated clock signal.

Alternately, when at least two preset values are stored, the preset values may be acquired successively in an order from the minimum preset value to the maximum preset value, and the delay operation is performed to the boosted scanning start signal according to each of the acquired preset values, so as to generate clock signals corresponding to each of the preset values. A delay time for the boosted scanning start signal gets longer successively in an order from the minimum preset value to the maximum preset value.

With the drive system and drive method of a liquid crystal display provided in the present invention, it can reduce the pins required by the timing controller and the level shifter, thus the packages of the timing controller and the level shifter get smaller, thereby reducing the package cost. Additionally, since the pins of the timing controller and the level shifter reduce, routings therebetween would be reduced as well. In this case, the size of the PCBA is reduced, and the cost of PCBA is reduced.

BRIEF DESCRIPTION OF THE DRAWINGS

These and/or other aspects, characteristics and advantages of the embodiments in the present disclosure will become apparent and more readily appreciated from the following description, taken in conjunction with the accompanying drawings in which.

DETAILED DESCRIPTION OF EXEMPLARY EMBODIMENTS

Embodiments of the present invention will be described in detail below by referring to the accompany drawings. However, the present invention can be implemented in numerous different forms, and the present invention may not be explained to be limited hereto. Instead, these embodiments are provided for explaining the principle and actual application of the present invention, thus other skilled in the art can understand various embodiments and amendments which are suitable for specific intended applications of the present invention.

Figure 1:
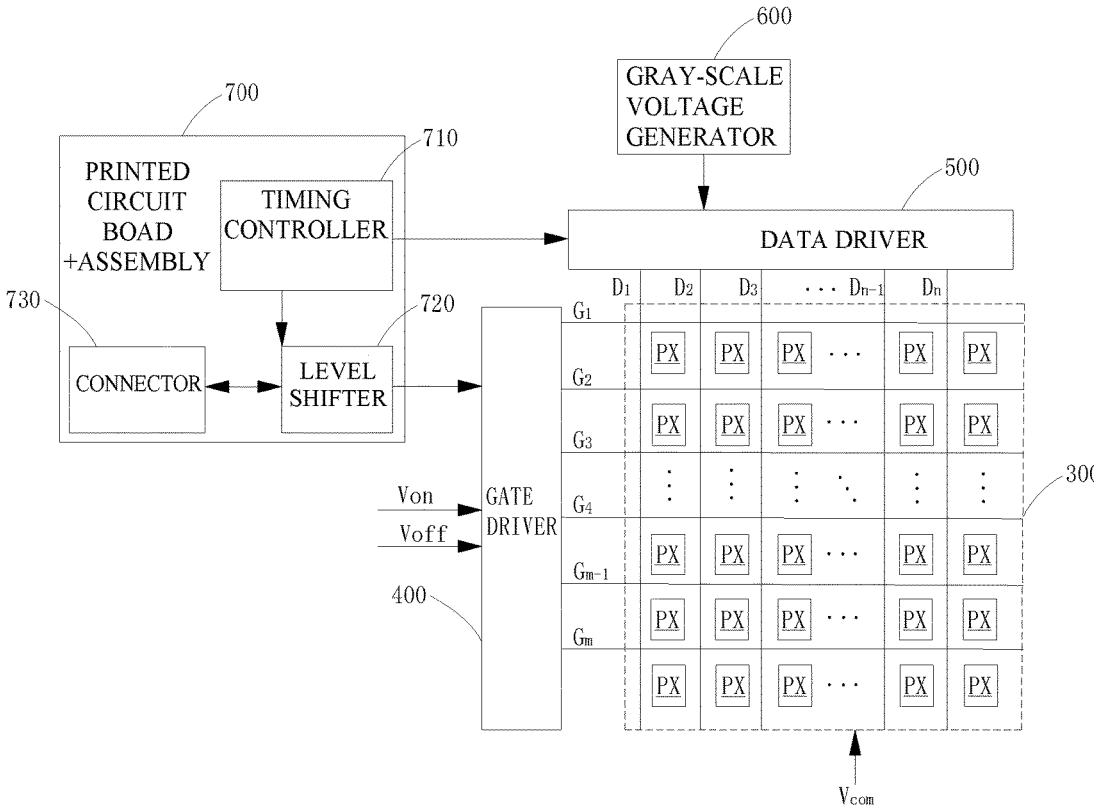
FIG. 1 is a block diagram of the liquid crystal display according to an embodiment of the present invention.

FIG. 1 is a block diagram of the liquid crystal display according to an embodiment of the present invention.

Referring to FIG. 1, the liquid crystal display according to an embodiment of the present invention includes: a liquid crystal panel assembly 300; a gate driver 400 and a data driver 500 both being connected to the liquid crystal panel assembly 300; a gray-scale voltage generator 600 connected to the data driver 500; and a Printed Circuit Board+Assembly (PCBA) 700 connected to the gate driver 400 and the data driver 500, to provide various signals to the gate driver 400 and the data driver 500.

In the preset embodiment, the PCBA 700 at least includes a timing controller 710, a level shifter 720 and a connector 730. The present invention is not limited thereto.

The liquid crystal display assembly 300 includes a plurality of display signal lines and a plurality of pixels PX connected to the display signal lines and arranged in an array. The liquid crystal panel assembly 300 may include a lower display panel (not shown) and an upper display panel (not shown) facing with each other, and a liquid crystal layer (not shown) inserted between the lower display panel and the upper display panel.

The display signal lines can be arranged on the lower display panel. The display signal lines may include a plurality of gate lines $G_1$ to $G_m$ for transferring gate signals and a plurality of data lines $D_1$ to $D_n$ for transferring data signals. The gate lines $G_1$ to $G_m$ extend in a row direction and are roughly parallel to each other, and the data lines $D_1$ to $D_n$ extend in a column direction and are roughly parallel to each other.

Each pixel PX includes: a switch connected to the corresponding gate line and the corresponding data line; and a liquid crystal capacitor connected to the switch. If necessary, each pixel PX may also include a storage capacitor, which is connected to the liquid crystal capacitor in parallel.

The switch of each pixel PX is a three-terminal device, thus the switch has a control terminal connected to the corresponding gate line, an input terminal connected the corresponding data line and an output terminal connected to the corresponding liquid crystal capacitor.

The gate driver 400 is connected to the gate lines $G_1$ to $G_m$ and applies gate signals to the gate lines $G_1$ to $G_m$. The gate signal is a combination of a gate turn-on voltage Von and a gate turn-off voltage Voff, which are provided to the gate driver 400 by an external source. Referring to FIG. 1, the gate driver 400 is arranged at one side of the liquid crystal panel assembly 300, and the gate lines $G_1$ to $G_m$ are all connected to the gate driver 400. However, the present applicant is not limited thereto. That is to say, a gate driver 400 may be arranged at each of both sides of the liquid crystal panel assembly 300, and the gate lines $G_1$ to $G_m$ are all connected to each of the two gate drivers 400.

In the present embodiment, the gate driver 400 can be embedded into the liquid crystal panel assembly 300.

The gray-scale voltage generator 600 generates a gray-scale voltage that is closely related to the transmittance of the pixel PX. The gray-scale voltage is provided to each pixel PX and has a positive value or a negative value according to a common voltage Vcom.

The data driver 500 is connected to the data lines $D_1$ to $D_n$ of the liquid crystal panel assembly 300, and applies the gray-scale voltage generated by the gray-scale voltage generator 600 to the pixel PX as a data voltage. If the gray-scale voltage generator 600 only supplies a reference gray-scale voltage instead of all the gray-scale voltage, the data driver 500 may divide the reference gray-scale voltage to generate various gray-scale voltages and choose one of the various gray-scale voltages as a data voltage.

In the present embodiment, the data driver 500 and the gray-scale voltage generator 600 both can be embedded in the liquid crystal panel assembly 300.

The timing controller 710 on the PCBA 700 controls operations of the gate driver 400 and the data driver 500.

The timing controller 710 receives input image signals (RGB signals) from an external graphic controller (not shown) and a plurality of input control signals such as a vertical synchronizing signal Vsync, a horizontal synchronizing signal Hsync, a master clock signal MCLK, and a data enable signal DE, for controlling the displaying of the input image signals. The timing controller 710processes the input image signals properly according to the input control signal, thereby generating image data DAT complying with the operating condition of the liquid crystal panel assembly 300. Then, the timing controller 710 generates a gate control signal CONT 1 and a data control signal CONT 2, and transfers the gate control signal CONT 1 to the gate driver 400 and transfers the data control signal CONT 2 and the image data DAT to the data driver 500.

The gate control signal CONT 1 may include: a scanning start signal STV 1 which can be used to start operation (i.e., scanning operation) of the gate driver 400 after being boosted. The gate control signal CONT 1 may also include an output enable signal capable of limiting the duration of the gate turn-on voltage Von. To clarify, it is different from the prior art that the gate control signal CONT 1 in the present embodiment does not include a clock signal CKV.

Furthermore, the timing controller 710 transfers the gate control signal CONT 1 to the level shifter 720. The level shifter 720 generates at least one clock signal CKV according to the received scanning start signal STV 1, and boosts the gate control signal CONT 1, and transfers the boosted gate control signal CONT 1 and the clock signal CKV to the gate driver 400.

The data control signal CONT 2 may include: a horizontal sync start signal STH which indicates a transmission of the image data DAT; a loading signal LOAD which requests to apply data voltages corresponding to the image data DAT to the data lines $D_1$ to $D_n$; and a data clock signal HCLK. The data control signal CONT 2 may also include a reverse signal RVS for reversing a polarity of the data voltage with respect to the common voltage Vcom, and hereinafter the polarity will be called "the polarity of the data voltage".

The data controller 500 receives the image data DAT from thetiming controller 710 in response to the data control signal CONT 2, and selects a gray-scale voltage corresponding to the image data DAT to convert the image data into a data voltage. Then, the data driver 500 supplies the data voltage to the data lines $D_1$ to $D_n$.

The gate driver 400 turns on the switch connected to the gate lines $G_1$ to $G_m$ by appling the gate turn-on voltage Von to the gate lines $G_1$ to $G_m$ in response to the boosted gate control signal CONT 1 and the clock signal CKV. Then, the data voltage applied to the data lines $D_1$ to $D_n$ is transferred to each pixel PX through the switch which is turned on.

A difference between the data voltage applied to each pixel PX and the common voltage Vcom can be interpreted as a voltage for charging the liquid crystal capacitor of each pixel PX, namely, a pixel voltage. The arrangement of the liquid crystal moleculesin the liquid crystal layer changes in accordance with the magnitude of the pixel voltage, thus the polarity of the light transferred through the liquid crystal layer may also change, which causes a variation of the transmittance of the liquid crystal layer.

Figure 2:
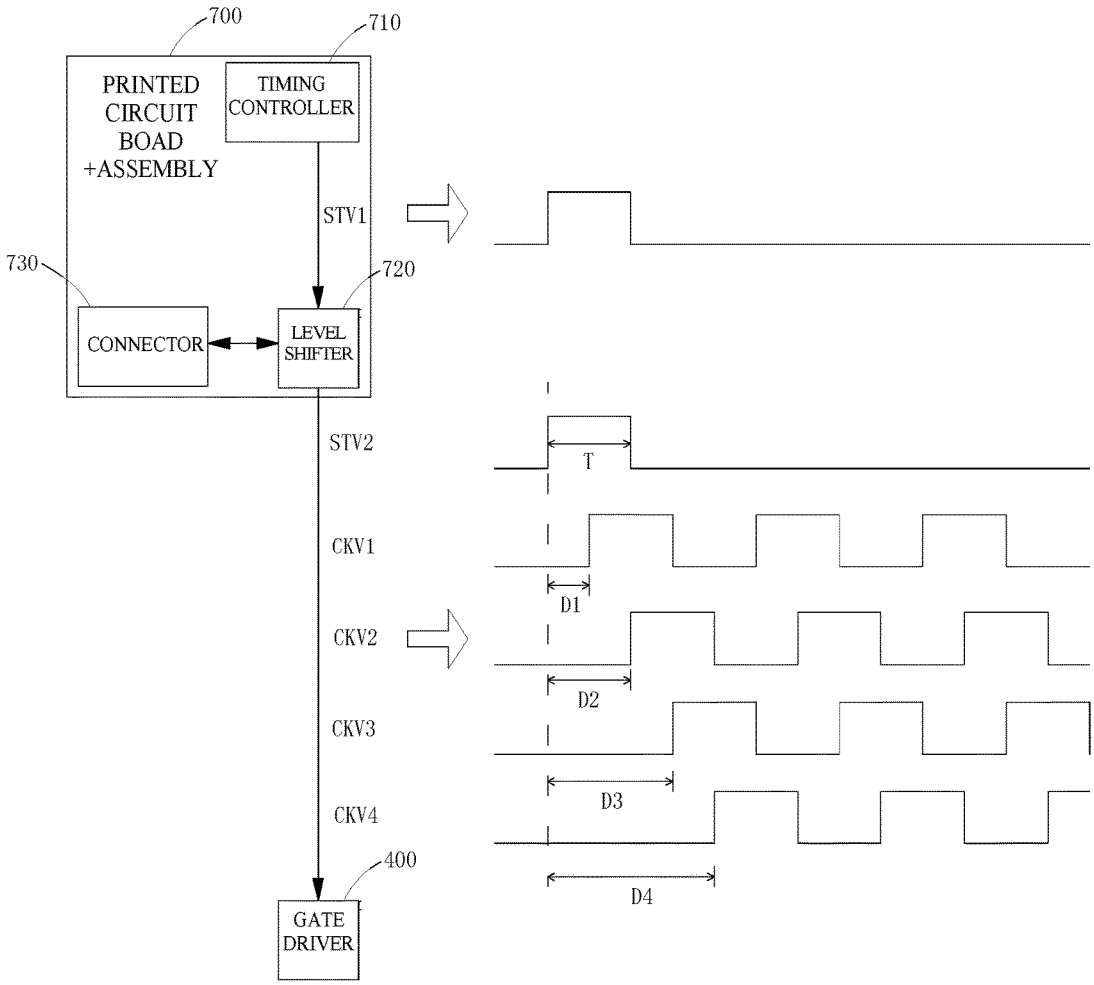
FIG. 2 is an architecture diagram of the PCBA and the gate driver, and a waveform graph of the signals generated thereby, according to an embodiment of the present invention.

Signal generation and transmission between the PCBA 700 and the gate driver 400 will be further explained in details below. FIG. 2 is an architecture diagram of the PCBA and the gate driver, and a waveform graph of the signals generated thereby according to an embodiment of the present invention. In FIG. 2, other components excluding the PCBA 700 and the gate driver 400 of the liquid crystal display are not shown, and these omitted components may be shown in FIG. 1.

Referring to FIG. 2, as mentioned above, the timing controller 710 generates the gate control signal CONT 1. The gate control signal CONT 1 at least includes: a scanning start signal STV 1 which can be used to start operation (i.e., scanning operation) of the gate driver 400 after being boosted. To clarify, it is different from the prior art that the gate control signal CONT 1 in the present embodiment does not include a clock signal CKV.

The timing controller 710 transfers the scanning start signal STV 1 to the level shifter 720. The level shifter 720 boosts the scanning start signal STV 1 and generates four clock signals CKV 1, CKV 2, CKV 3 and CKV 4 according to the boosted scanning start signal STV 2. Certainly, it should be understood that the number of the clock signals here is only an example.

Figure 3:
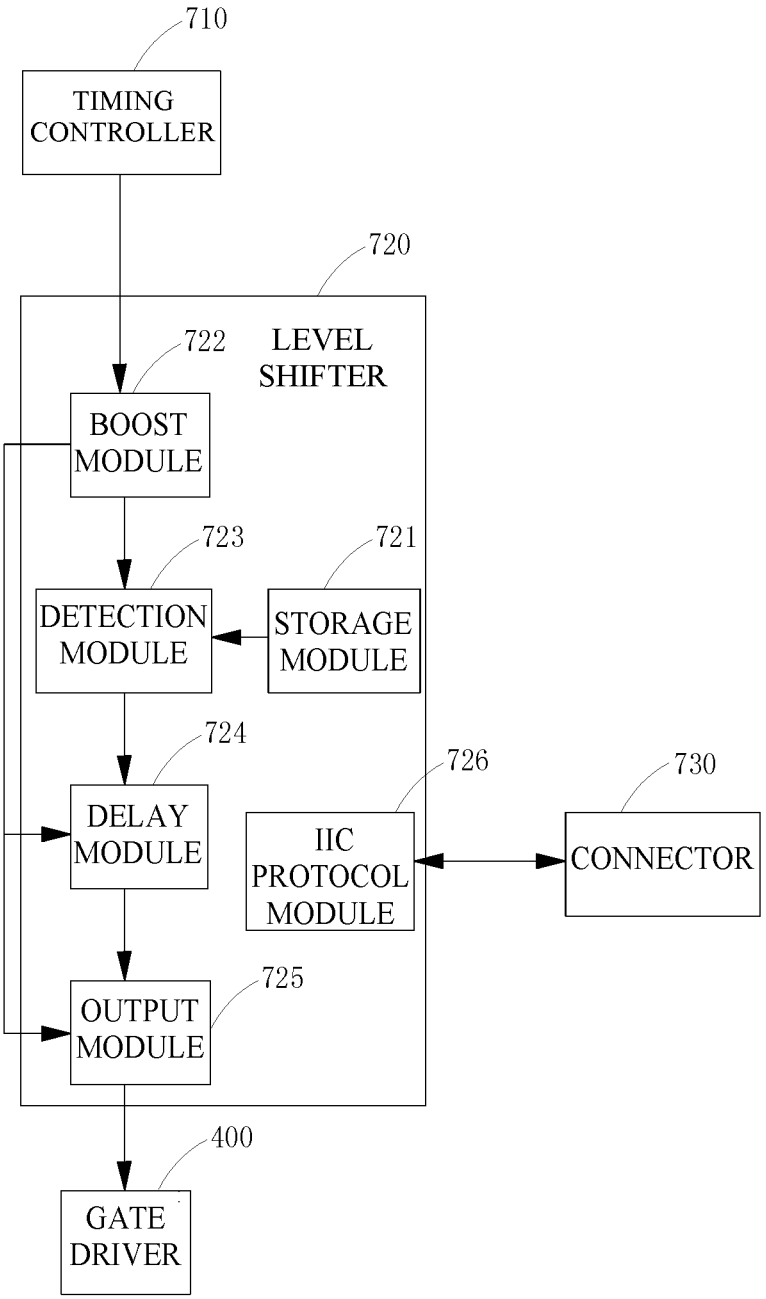
FIG. 3 is a module diagram of the level shifter according to an embodiment of the present invention.

FIG. 3 is a module diagram of the level shifter according to an embodiment of the present invention.

Referring to FIGS. 2 and 3, the level shifter 720 according to the embodiment of the present invention includes: a storage module 721, a boost module 722, a detection module 723, a delay module 724 and an output module 725.

The storage module 721 serves to store four preset values. Here, each preset value corresponds to a clock signal. For illustration purpose, the four preset values are distinguished by a first preset value, a second preset value, a third preset value and a fourth preset value. The boost module 722 boosts the scanning start signal STV 1 and generates the boosted scanning start signal STV 2. The detection module 723 serves to detect a rising edge of the boosted scanning start signal STV 2.

When the detection module 723 detects the rising edge of the boosted scanning start signal STV 2, the delay module 724 acquires four preset values from the storage module 721 successively, and performs a delay operation on the boosted scanning start signal STV 2 according to each preset value, so as to form the clock signals CKV corresponding to the preset values.

The output module 725 transfers the boosted scanning start signal STV 2 and the generated four clock signals CKV 1, CKV2, CKV 3 and CKV 4.

In particular, a delay time for the boosted scanning start signal STV 2 corresponding to each preset value is different. For example, the smaller the preset value is, the shorter the delay time for the corresponding boosted scanning start signal is. It should be understood that, as another embodiment, it can be set that the larger the preset value is, the shorter the delay time for the corresponding boosted scanning start signal STV 2 gets.

Preferably, the shortest delay time for the boosted scanning start signal STV 2 is a half of a high level duration T of the boosted scanning start signal STV 2.

In the present embodiment, the first preset value, the second preset value, the third preset value and the fourth preset value increase successively. The delay time for the boosted scanning start signal STV 2 corresponding to the first preset value is D1, where D1=T/2. The delay time for the boosted scanning start signal STV 2 corresponding to the second preset value is D2, where D2=T. The delay time for the boosted scanning start signal STV 2 corresponding to the third preset value is D3, where D3=3T/2. The delay time for the boosted scanning start signal STV 2 corresponding to the fourth preset value is D4, where D4=2T. That is to say, the delay time for the boosted scanning start signal STV 2 increases successively in an order from the minimum preset value to the maximum preset value by a half of the high level duration T of the boosted scanning start signal STV 2.

Furthermore, when the detection module 723 detects the rising edge of the boosted scanning start signal STV 2, the delay module 724 acquires four preset values in the order from the minimum preset value to the maximum preset value, from the storage module 721.

For example, when the detection module 723 detects the rising edge of the boosted scanning start signal STV 2, the delay module 724 acquires the first preset value from the storage module 721, and delays the boosted scanning start signal STV 2 by D1 according to the first preset value, so as to form the clock signal CKV 1 corresponding to the first preset value. Next, the delay module 724 acquires the second preset value from the storage module 721, and delays the boosted scanning start signal STV 2 by D2 according to the second preset value, so as to form the clock signal CKV 2 corresponding to the second preset value. Next, the delay module 724 acquires the third preset value from the storage module 721, and delays the boosted scanning start signal STV 2 by D3 according to the third preset value, so as to form the clock signal CKV 3 corresponding to the third preset value. Next, the delay module 724 acquires the fourth preset value from the storage module 721, and delays the boosted scanning start signal STV 2 by D4 according to the fourth preset value, so as to form the clock signal CKV 4 corresponding to the fourth preset value.

In addition, the level shifter 720 also includes an IIC protocol module 726. The level shifter 720 communicates with the connector 730 through the IIC protocol module 726. Thus, a user or a designer may adjust the preset values in the storage module of the level shifter 720 through the connector 730, so as to adjust the clock signals generated by the delay module 724 of the level shifter 720, thus the PCBA 700 can be applied in various types of liquid crystal displays.

Figure 4:
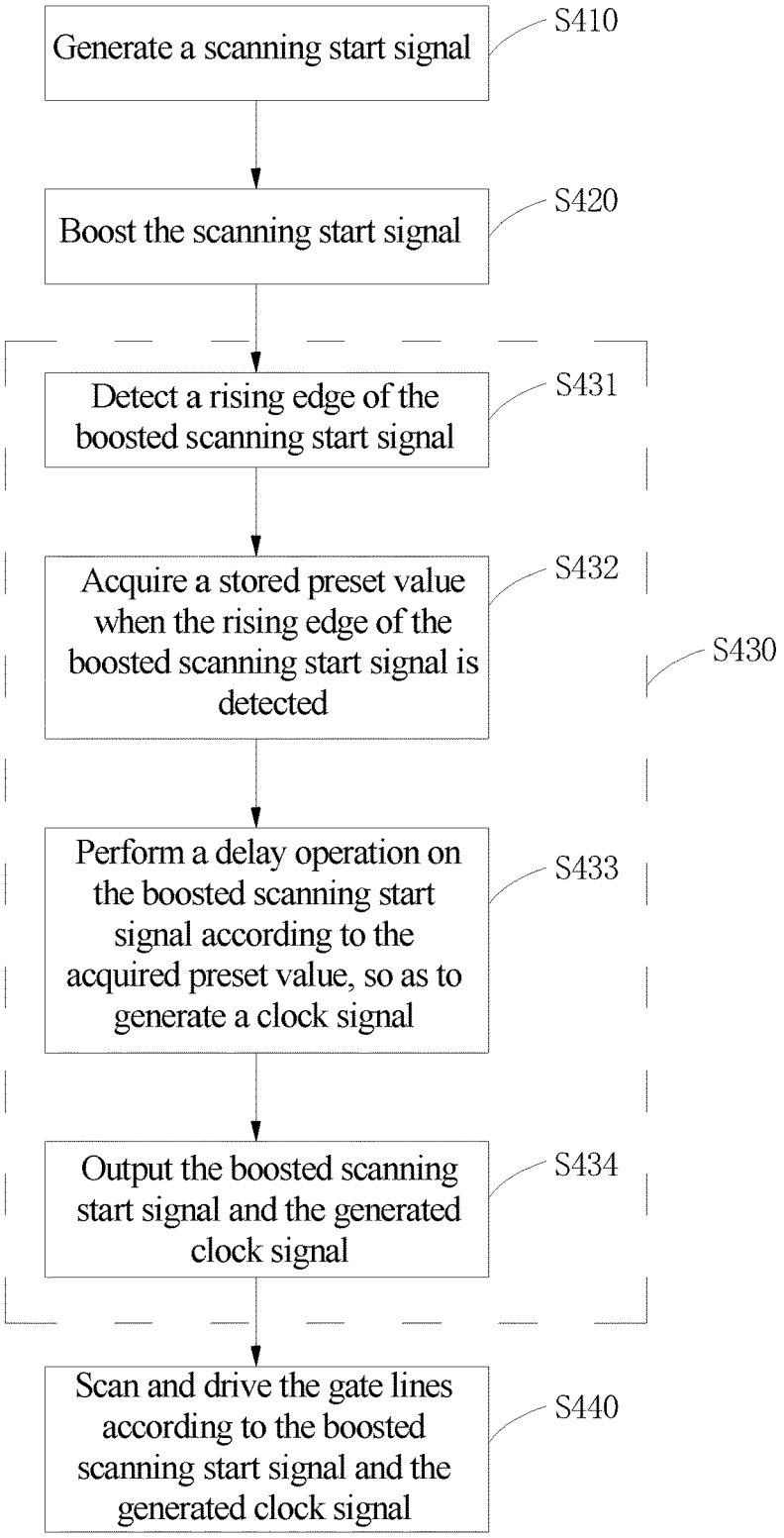
FIG. 4 is a flow chart of the drive method of the liquid crystal display according to an embodiment of the present invention.

FIG. 4 is a flow chart of the drive method of the liquid crystal display according to an embodiment of the present invention.

Referring to FIGS. 2-4, in step 5410, the gate control signal CONT 1 is generated.

In particular, the timing controller 710 is used to generate the gate control signal CONT 1. Here, the gate control signal CONT 1 at least includes a scanning start signal STV 1 which can be used to start operation (i.e., scanning operation) of the gate driver 400 after being boosted. To clarify, it is different from the prior art that the gate control signal CONT 1 in the present embodiment does not include a clock signal CKV.

The timing controller 710 transfers the scanning start signal STV 1 to the level shifter 720.

In step S420, the generated scanning start signal STV 1 is boosted.

In particular, the boost module 722 of the level shifter 720 is used to boost the scanning start signal STV 1, so as to generate the boosted scanning start signal STV 2.

In step S430, clock signals are generated according to the boosted scanning start signal STV 2.

In particular, in the present embodiment, the step S430 further includes steps S431, S432, S433 and S434.

In step S431, a rising edge of the boosted scanning start signal STV 2 is detected. In particular, the detection module 723 of the level shifter 720 is used to detect the rising edge of the boosted scanning start signal STV 2.

In step S432, stored preset values are acquired when the rising edge of the boosted scanning start signal is detected. Particularly, when the detection module 723 of the level shifter 720 detects the rising edge of the boosted scanning start signal STV 2, the delay module 724 of the level shifter 720 is used to acquire preset values form the storage module 721.

In the present embodiment, the storage module 721 stores four preset values. Here, each preset value corresponds to one clock signal. For illustration purpose, the four preset values are distinguished by a first preset value, a second preset value, a third preset value and a fourth preset value. The number of the present values can be set according to actual needs.

In the present embodiment, preferably, the first preset value, the second preset value, the third preset value and the fourth preset value increase successively. Furthermore, when the detection module 723 of the level shifter 720 detects the rising edge of the boosted scanning start signal STV 2, the delay module 724 of the level shifter 720 is used to acquire four preset values successively from the storage module 721 in the order from the minimum preset value to the maximum preset value.

In step S433, a delay operation is performed on the boosted scanning start signal STV 2 according to the acquired preset value, so as to generate a clock signal. In particular, the delay module 724 of the level shifter 720 is used to delay the boosted scanning start signal STV 2 according to the acquired preset value, so as to generate a clock signal CKV.

In the present embodiment, the delay module 724 of the level shifter 720 performs a delay operation on the boosted scanning start signal STV 2 according to the preset values acquired successively, so as to form the clock signal CKV corresponding to each preset value. Thus, four clock signals CKV 1, CKV2, CKV 3 and CKV 4 are formed. That is to say, the four clock signals CKV 1, CKV2, CKV 3 and CKV 4 are formed successively.

The delay time for the boosted scanning start signal STV 2 corresponding to each preset value is different. For example, the smaller the preset value is, the shorter the delay time for the corresponding boosted scanning start signal is. It should be understood that, as another embodiment, it can be set that the larger the preset value is, the shorter the delay time for the corresponding boosted scanning start signal STV 2 is.

Preferably, the shortest delay time for the boosted scanning start signal STV 2 is a half of a high level duration T of the boosted scanning start signal STV 2.

The delay time for the boosted scanning start signal STV 2 corresponding to the first preset value is D1, where D1=T/2. The delay time for the boosted scanning start signal STV 2 corresponding to the second preset value is D2, where D2=T. The delay time for the boosted scanning start signal STV 2 corresponding to the third preset value is D3, where D3=3T/2. The delay time for the boosted scanning start signal STV 2 corresponding to the fourth preset value is D4, where D4=2T. That is to say, the delay time for the boosted scanning start signal STV 2 increases successively in an order from the minimum preset value to the maximum preset value by a half of the high level duration T of the boosted scanning start signal STV 2.

In step S434, the boosted scanning start signal and the generated clock signal are output. In particular, the output module 725 of the level shifter 720 is used to output the boosted scanning start signal STV 2 and the generated four clock signals CKV 1, CKV2, CKV 3 and CKV 4.

In step S440, the gate lines are scaned and drived according to the boosted scanning start signal and the generated clock signals. In particular, the gate driver 400 is used to scan and drive the gate lines $G_1$ to $G_m$ progressively according to the boosted scanning start signal STV 2 and the generated four clock signals CKV 1, CKV2, CKV3 and CKV 4. For the specific drive method, please refer to the description about the gate driver 400 in FIG. 1 below.

According to the embodiments of the present invention, it can reduce the pins required by the timing controller and the level shifter, thus the package model of the timing controller and the level shifter gets smaller, thereby reducing the package cost. Additionally, since the pins of the timing controller and the level shifter reduce, routings therebetween would be reduced as well. In this case, the size of the PCBA is reduced, and thus the cost of PCBA is reduced.

Although the present disclosure is described with reference to the specific embodiments, those skilled in the art will understand that various changes in form and details may be made therein without departing from the spirit and scope of the invention as defined by the appended claims and its equivalents.

The invention claimed is:

1. A drive system for a liquid crystal display, comprising:

a timing controller for generating a scanning start signal;

a level shifter for boosting the generated scanning start signal and generating at least one clock signal according to the boosted scanning start signal; and a gate driver for scanning and driving gate lines according to the boosted scanning start signal and the clock signal; and wherein the level shifter receives the scanning start signal generated by the timing controller as one single signal supplied from the timing controller to the level shifter and generates, from the scanning start signal, the boosted scanning signal and the at least one clock signal that is generated by delaying a rising edge of the boosted scanning start signal by a delay time so that the boosted scanning start signal and the at least one clock signal are determined by the scanning start signal that is supplied as one single signal from the timing controller to the level shifter and the delay time, wherein the at least one clock signal lags behind the boosted scanning signal by the delay time.

2. The drive system of claim 1, wherein the level shifter is also used to store at least one preset value that determines the delay time, and to perform a delay operation on the boosted scanning start signal according to the stored preset value, so as to delay the rising edge of the boosted scanning start signal by the delay time to generate the at least one clock signal.

3. The drive system of claim 2, wherein the level shifter is also used to perform the delay operation on the boosted scanning start signal according to the stored preset value so as to generate the clock signal, when the rising edge of the boosted scanning start signal is detected.

4. The drive system of claim 3, wherein the level shifter comprises:

a boost module for boosting the generated scanning start signal;

a storage module for storing the at least one preset value;

a detection module for detecting the rising edge of the boosted scanning start signal;

a delay module for acquiring the at least one preset value from the storage module when the detection module detects the rising edge of the boosted scanning start signal, and performing the delay operation on the boosted scanning start signal according to the acquired preset value, so as to generate the at least one clock signal; and an output module for outputting the boosted scanning start signal and the clock signal.

5. The drive system of claim 4, wherein the at least one preset value stored in the storage module comprises at least two preset values including a minimum preset value and a maximum preset value, and the delay module acquire the at least two preset values successively in an order from the minimum preset value to the maximum preset value, and perform the delay operation on the boosted scanning start signal according to each of the at least two preset values so acquired, so as to generate a clock signal corresponding to each of the at least two preset values.

6. The drive system of claim 5, wherein the delay time by which the rising edge of the boosted scanning start signal is delayed is such that the delay time gets longer successively in an order from the minimum preset value to the maximum preset value.

7. The drive system of claim 1, wherein the timing controller and the level shifter are assembled on a Printed Circuit Board Assembly (PCBA), and the level shifter comprises: an IIC protocol module for communicating with a connector on the PCBA.

8. A drive method of a liquid crystal display, comprising:

generating a single scanning start signal;

boosting the single scanning start signal to generate a boosted scanning start signal;

generating a clock signal according to the boosted scanning start signal; and scanning and driving gate lines according to the boosted scanning start signal and the clock signal;

wherein the clock signal is generated by delaying a rising edge of the boosted scanning start signal by a delay time so that the boosted scanning start signal and the clock signal are determined by the single scanning start signal and the delay time such that the at least one clock signal lags behind the boosted scanning signal by the delay time.

9. The drive method of claim 8, wherein the clock signal that is generated according to the boosted scanning start signal is generated with a process that comprises the following steps:

detecting the rising edge of the boosted scanning start signal;

acquiring a stored preset value when the rising edge of the boosted scanning start signal is detected;

performing a delay operation on the boosted scanning start signal according to the acquired preset value, so as to delay the rising edge of the boosted scanning start signal by the delay time to generate the clock signal; and outputting the boosted scanning start signal and the clock signal.

10. The drive method of claim 9, wherein when at least two preset values including a minimum preset value and a maximum preset value are stored, the at least two preset values are acquired successively in an order from the minimum preset value to the maximum preset value, and the delay operation is performed on the boosted scanning start signal according to each of the at least two preset values so acquired, so as to generate a clock signal corresponding to each of the at least two preset values, and wherein the delay time by which the rising edge of the boosted scanning start signal is delayed is such that the delay time gets longer successively in an order from the minimum preset value to the maximum preset value.

* * * * *